US011613789B2

(12) United States Patent
Lu et al.

(10) Patent No.: US 11,613,789 B2
(45) Date of Patent: Mar. 28, 2023

(54) METHOD FOR IMPROVING BOTH STRENGTH AND DUCTILITY OF A PRESS-HARDENING STEEL

(71) Applicant: GM GLOBAL TECHNOLOGY OPERATIONS LLC, Detroit, MI (US)

(72) Inventors: Qi Lu, Shanghai (CN); Jiachen Pang, Shanghai (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 79 days.

(21) Appl. No.: 17/058,464

(22) PCT Filed: May 24, 2018

(86) PCT No.: PCT/CN2018/088122

§ 371 (c)(1),
(2) Date: Nov. 24, 2020

(87) PCT Pub. No.: WO2019/222950

PCT Pub. Date: Nov. 28, 2019

(65) Prior Publication Data

US 2021/0198760 A1 Jul. 1, 2021

(51) Int. Cl.
*C21D 1/673* (2006.01)
*C21D 1/74* (2006.01)
(Continued)

(52) U.S. Cl.
CPC ..... *C21D 1/673* (2013.01); *B21D 22/022* (2013.01); *C21D 1/74* (2013.01); *C21D 9/0068* (2013.01);
(Continued)

(58) Field of Classification Search
None
See application file for complete search history.

(56) References Cited

U.S. PATENT DOCUMENTS 1,828,325 A 10/1931 Kurz
2,178,281 A 10/1939 Judge
(Continued)

FOREIGN PATENT DOCUMENTS

CA 2378934 A1 9/2003
CN 101270453 A 9/2008
(Continued)

OTHER PUBLICATIONS

Second Office Action for Chinese Patent Application No. 201780098042.5 dated Nov. 17, 2021, with correspondence dated Nov. 22, 2021, from China Patent Agent (H.K.) Ltd summarizing contents; 9 pages.
(Continued)

*Primary Examiner* — Anthony M Liang
(74) *Attorney, Agent, or Firm* — Harness, Dickey & Pierce, P.L.C.

(57) ABSTRACT

A method of forming a shaped steel object, includes cutting a blank from an alloy composition. The alloy composition includes 0.1-1 wt. % carbon, 0.1-3 wt. % manganese, 0.1-3 wt. % silicon, 1-10 wt. % aluminum, and a balance being iron. The method also includes heating the blank to a temperature above a temperature at which austenite begins to form to generate a heated blank, transferring the heated blank to a die, forming the heated blank into a predetermined shape defined by the die to generate a shaped steel object, and decreasing the temperature of the shaped steel object to ambient temperature. The heating is performed under an atmosphere comprising at least one of an inert gas, a carbon (C)-based gas, and nitrogen ($N_2$) gas.

18 Claims, 3 Drawing Sheets

(51) Int. Cl.

| | |
|---|---|
| ***C21D 9/00*** | (2006.01) |
| ***C22C 38/02*** | (2006.01) |
| ***C22C 38/04*** | (2006.01) |
| ***C22C 38/06*** | (2006.01) |
| ***B21D 22/02*** | (2006.01) |

(52) U.S. Cl.

CPC ..... *C22C 38/02* (2013.01); *C22C 38/04* (2013.01); *C22C 38/06* (2013.01); *C21D 2211/001* (2013.01); *C21D 2211/008* (2013.01)

(56) References Cited

U.S. PATENT DOCUMENTS

| | | | |
|---|---|---|---|
| 3,111,436 | A | 11/1963 | McGavin |
| 3,330,705 | A | 7/1967 | Madrzyk et al. |
| 3,340,102 | A | 9/1967 | Kulin et al. |
| 3,516,874 | A | 6/1970 | Maker et al. |
| 3,907,614 | A | 9/1975 | Bramfitt et al. |
| 4,086,104 | A | 4/1978 | Kinoshita et al. |
| 4,146,411 | A | 3/1979 | Dewsnap et al. |
| 4,327,156 | A | 4/1982 | Dillon et al. |
| 4,486,248 | A | 12/1984 | Ackert et al. |
| 4,533,401 | A | 8/1985 | Yutori et al. |
| 4,744,836 | A | 5/1988 | Pfaffmann |
| 5,205,145 | A | 4/1993 | Ishino et al. |
| 5,358,578 | A | 10/1994 | Tischhauser |
| 5,554,233 | A | 9/1996 | Heitmann et al. |
| 5,989,647 | A | 11/1999 | Remy et al. |
| 6,270,594 | B1 | 8/2001 | Bodnar et al. |
| 6,296,805 | B1 | 10/2001 | Laurent et al. |
| 6,330,740 | B1 | 12/2001 | Krempels |
| 6,364,972 | B1 | 4/2002 | Bauer et al. |
| 6,564,604 | B2 | 5/2003 | Kefferstein et al. |
| 7,166,372 | B2 | 1/2007 | Bose et al. |
| 7,393,421 | B2 | 7/2008 | Yang |
| 7,677,070 | B2 | 3/2010 | Kobayashi |
| 7,703,312 | B2 | 4/2010 | Walter |
| 7,727,337 | B2 | 6/2010 | Sachdev et al. |
| 7,941,907 | B2 | 5/2011 | Yang et al. |
| 8,007,923 | B2 | 8/2011 | Sakakibara et al. |
| 8,141,230 | B2 | 3/2012 | Brodt et al. |
| 8,252,125 | B2 | 8/2012 | Giefers et al. |
| 8,440,323 | B2 | 5/2013 | Spehner et al. |
| 8,614,008 | B2 | 12/2013 | Canourgues et al. |
| 8,671,729 | B2 | 3/2014 | Verma et al. |
| 8,733,142 | B2 | 5/2014 | Spehner et al. |
| 8,778,261 | B2 | 7/2014 | Nakamura et al. |
| 8,888,934 | B2 | 11/2014 | Bian |
| 8,926,770 | B2 | 1/2015 | Kobayashi et al. |
| 8,932,416 | B2 | 1/2015 | Nakanishi et al. |
| 8,992,697 | B2 | 3/2015 | Matsuda et al. |
| 9,359,663 | B2 | 6/2016 | Mizuta et al. |
| 9,475,113 | B2 | 10/2016 | Naitou et al. |
| 9,512,499 | B2 | 12/2016 | Tomokiyo et al. |
| 9,534,268 | B2 | 1/2017 | Ratte |
| 9,593,392 | B2 | 3/2017 | John et al. |
| 9,598,745 | B2 | 3/2017 | Hayashi et al. |
| 9,605,329 | B2 | 3/2017 | Nonaka et al. |
| 9,611,518 | B2 | 4/2017 | Naitou et al. |
| 9,617,624 | B2 | 4/2017 | Tanahashi et al. |
| 9,644,247 | B2 | 5/2017 | Matsuda et al. |
| 9,694,415 | B2 | 7/2017 | Shan et al. |
| 9,725,782 | B2 | 8/2017 | Nonaka et al. |
| 9,835,194 | B2 | 12/2017 | Chiba et al. |
| 9,840,751 | B2 | 12/2017 | Hayashi et al. |
| 9,850,554 | B2 | 12/2017 | Naitou et al. |
| 9,896,736 | B2 | 2/2018 | Tomokiyo et al. |
| 9,909,194 | B2 | 3/2018 | Puerta Velasquez et al. |
| 9,920,407 | B2 | 3/2018 | Nonaka et al. |
| 9,945,013 | B2 | 4/2018 | Nonaka et al. |
| 10,029,294 | B2 | 7/2018 | Yamano et al. |
| 10,030,280 | B2 | 7/2018 | Hayashi et al. |
| 10,072,324 | B2 | 9/2018 | Nonaka et al. |
| 10,260,121 | B2 | 4/2019 | Lu et al. |
| 10,385,415 | B2 | 8/2019 | Wang et al. |
| 10,472,691 | B2 | 11/2019 | Köyer et al. |
| 10,619,223 | B2 | 4/2020 | Wang |
| 10,822,681 | B2 | 11/2020 | Schottler et al. |
| 2009/0155615 | A1 | 6/2009 | Chen et al. |
| 2009/0238715 | A1 | 9/2009 | Cho et al. |
| 2010/0026048 | A1 | 2/2010 | Vlot et al. |
| 2010/0028190 | A1 | 2/2010 | Wang |
| 2010/0269957 | A1 | 10/2010 | Akerstrom et al. |
| 2011/0139308 | A1 | 6/2011 | Peruzzi et al. |
| 2012/0211131 | A1 | 8/2012 | Altschuler et al. |
| 2012/0267012 | A1 | 10/2012 | Sohn et al. |
| 2013/0048161 | A1 | 2/2013 | Matsuda et al. |
| 2013/0180969 | A1 | 7/2013 | Cheng et al. |
| 2013/0186527 | A1 | 7/2013 | Bradley |
| 2013/0199679 | A1 | 8/2013 | Toji et al. |
| 2014/0020795 | A1 | 1/2014 | Schwinghammer et al. |
| 2014/0057121 | A1 | 2/2014 | Altschuler et al. |
| 2014/0065007 | A1 | 3/2014 | Naitou et al. |
| 2014/0096876 | A1 | 4/2014 | Matsuda et al. |
| 2014/0212687 | A1 | 7/2014 | Vlot et al. |
| 2014/0261918 | A1 | 9/2014 | Jin et al. |
| 2014/0261920 | A1* | 9/2014 | Shan ..... C21D 8/005 72/359 |
| 2014/0322559 | A1 | 10/2014 | Becker et al. |
| 2015/0020992 | A1 | 1/2015 | Schottler et al. |
| 2015/0024237 | A1 | 1/2015 | Tanahashi et al. |
| 2015/0082636 | A1 | 3/2015 | Gruneklee et al. |
| 2015/0090377 | A1 | 4/2015 | Murakami et al. |
| 2015/0114199 | A1 | 4/2015 | Shepard et al. |
| 2015/0203946 | A1 | 7/2015 | Hammer et al. |
| 2015/0225830 | A1 | 8/2015 | Nonaka et al. |
| 2016/0010168 | A1 | 1/2016 | Angles et al. |
| 2016/0017452 | A1 | 1/2016 | Puerta Velasquez et al. |
| 2016/0145707 | A1 | 5/2016 | Feuser et al. |
| 2016/0145731 | A1 | 5/2016 | Sachdev et al. |
| 2016/0147573 | A1 | 5/2016 | Shayesteh et al. |
| 2016/0215376 | A1 | 7/2016 | Luther et al. |
| 2016/0244855 | A1 | 8/2016 | Steinebach et al. |
| 2016/0319389 | A1 | 11/2016 | Hayashi et al. |
| 2017/0029913 | A1 | 2/2017 | Bae et al. |
| 2017/0051372 | A1 | 2/2017 | Tomokiyo et al. |
| 2017/0314088 | A1 | 11/2017 | Wang |
| 2017/0314089 | A1 | 11/2017 | Wang |
| 2017/0321294 | A1 | 11/2017 | Arlazarov et al. |
| 2017/0342523 | A1 | 11/2017 | Wang et al. |
| 2018/0030567 | A1 | 2/2018 | Yi et al. |
| 2018/0216205 | A1 | 8/2018 | Wang et al. |
| 2018/0223385 | A1 | 8/2018 | Lu et al. |
| 2018/0237877 | A1 | 8/2018 | Wang et al. |
| 2018/0237892 | A1 | 8/2018 | Schottler et al. |
| 2018/0251875 | A1 | 9/2018 | Pavlina |
| 2018/0312954 | A1 | 11/2018 | Yasui et al. |
| 2019/0127829 | A1 | 5/2019 | Santacreu et al. |
| 2020/0063232 | A1 | 2/2020 | Lu et al. |
| 2020/0157665 | A1 | 5/2020 | Lu et al. |
| 2020/0190611 | A1 | 6/2020 | Lu et al. |
| 2020/0325552 | A1 | 10/2020 | Mraczek et al. |
| 2021/0002746 | A1 | 1/2021 | Lu et al. |
| 2021/0087661 | A1 | 3/2021 | Lu et al. |
| 2021/0189531 | A1 | 6/2021 | Lu et al. |
| 2021/0198760 | A1 | 7/2021 | Lu et al. |
| 2021/0222265 | A1 | 7/2021 | Lu et al. |
| 2021/0276065 | A1 | 9/2021 | Pang et al. |

FOREIGN PATENT DOCUMENTS

| | | | |
|---|---|---|---|
| CN | 101713046 | A | 5/2010 |
| CN | 102031456 | A | 4/2011 |
| CN | 102284523 | A | 12/2011 |
| CN | 102644028 | A | 8/2012 |
| CN | 102719783 | A | 10/2012 |
| CN | 102758133 | A | 10/2012 |
| CN | 102803519 | A | 11/2012 |
| CN | 102828109 | A | 12/2012 |
| CN | 102906291 | A | 1/2013 |
| CN | 102912219 | A | 2/2013 |
| CN | 103045950 | A | 4/2013 |
| CN | 103108964 | A | 5/2013 |
| CN | 103547687 | A | 1/2014 |

(56) References Cited

FOREIGN PATENT DOCUMENTS

| | | | |
|---|---|---|---|
| CN | 103556048 | A | 2/2014 |
| CN | 103620075 | A | 3/2014 |
| CN | 103842546 | A | 6/2014 |
| CN | 104160050 | A | 11/2014 |
| CN | 104160051 | A | 11/2014 |
| CN | 104195455 | A | 12/2014 |
| CN | 104379272 | A | 2/2015 |
| CN | 104846274 | A | 8/2015 |
| CN | 105026597 | A | 11/2015 |
| CN | 105483531 | A | 4/2016 |
| CN | 105648317 | A | 6/2016 |
| CN | 105658821 | A | 6/2016 |
| CN | 105671435 | A | 6/2016 |
| CN | 105734413 | A | 7/2016 |
| CN | 105886750 | A | 8/2016 |
| CN | 106086683 | A | 11/2016 |
| CN | 106399834 | A | 2/2017 |
| CN | 106521338 | A | 3/2017 |
| CN | 106906421 | A | 6/2017 |
| CN | 106929755 | A | 7/2017 |
| CN | 107002155 | A | 8/2017 |
| CN | 107127238 | A | 9/2017 |
| CN | 107338345 | A | 11/2017 |
| CN | 107338349 | A | 11/2017 |
| CN | 107354385 | A | 11/2017 |
| CN | 107815612 | A | 3/2018 |
| CN | 108359781 | A | 8/2018 |
| CN | 110050084 | A | 7/2019 |
| CN | 111542635 | A | 8/2020 |
| CN | 112176245 | A | 1/2021 |
| CN | 112513310 | A | 3/2021 |
| CN | 112534078 | A | 3/2021 |
| DE | 102009060388 | A1 | 6/2011 |
| DE | 102012104734 | A1 | 12/2013 |
| DE | 102015119417 | A1 | 6/2016 |
| DE | 102017108835 | A1 | 11/2017 |
| DE | 102017108837 | A1 | 11/2017 |
| DE | 102018101735 | A1 | 8/2018 |
| DE | 112016007444 | T5 | 8/2019 |
| EP | 1878811 | A1 | 1/2008 |
| EP | 1930450 | B1 | 7/2011 |
| EP | 2524970 | A1 | 11/2012 |
| EP | 3013988 | A1 | 5/2016 |
| EP | 3020842 | B1 | 5/2016 |
| EP | 2866147 | B1 | 8/2016 |
| EP | 2719788 | B1 | 11/2016 |
| EP | 3473735 | A1 | 4/2019 |
| JP | H0384378 | A | 4/1991 |
| JP | H09263886 | A | 10/1997 |
| JP | 2000178640 | A | 6/2000 |
| JP | 2003147486 | A | 5/2003 |
| JP | 2003201549 | A | 7/2003 |
| JP | 2005163123 | A | 6/2005 |
| JP | 2006316309 | A | 11/2006 |
| JP | 2007321168 | A | 12/2007 |
| JP | 2008207279 | A | 9/2008 |
| JP | 2008261023 | A | 10/2008 |
| JP | 2010174302 | A | 8/2010 |
| JP | 2011016149 | A | 1/2011 |
| JP | 2011184768 | A | 9/2011 |
| JP | 5015356 | B2 | 8/2012 |
| JP | 2013204089 | A | 10/2013 |
| JP | 2016125101 | A | 7/2016 |
| KR | 20110034452 | A | 4/2011 |
| KR | 20160057541 | A | 5/2016 |
| SU | 711126 | A1 | 2/1980 |
| WO | WO-2008102012 | A1 | 8/2008 |
| WO | WO-2012120020 | A1 | 9/2012 |
| WO | WO-2014024831 | A1 | 2/2014 |
| WO | WO-2014037627 | A1 | 3/2014 |
| WO | 2014128656 | A1 | 8/2014 |
| WO | WO-2015102051 | A1 | 7/2015 |
| WO | WO-2016079565 | A1 | 5/2016 |
| WO | WO-2016095664 | A1 | 6/2016 |
| WO | WO-2016106621 | A1 | 7/2016 |
| WO | WO-2018107446 | A1 | 6/2018 |
| WO | WO-2019085855 | A1 | 5/2019 |
| WO | WO-2019127240 | A1 | 7/2019 |
| WO | WO-2019222950 | A1 | 11/2019 |
| WO | WO-2019241902 | A1 | 12/2019 |

OTHER PUBLICATIONS

First Office Action for Chinese Patent Application No. 201880096658.3 dated Nov. 18, 2021, with correspondence dated Nov. 22, 2021, from China Patent Agent (H.K.) Ltd summarizing contents; 8 pages.

Lu, Qi et al, U.S. Appl. No. 16/958,362, filed Jun. 26, 2020 entitled, "Steel for Hot Stamping With Enhanced Oxidation Resistance," 41 pages.

Cao et al.; Oxidation Kinetics and Spallation Model of Oxide Scale during Cooling Process of Low Carbon Microalloyed Steel; Sep. 24, 2016; de Gruyter; High Temperature Materials and Processes vol. 36 Issue 9, p. 1-10 (Year: 2016).

Yi et al., Dual-phase hot press forming alloy, 2010, Elsevier, Materials Science and Engineering A, p. 4870-4874 (Year: 2010).

Lu, Qi et al., U.S. Appl. No. 17/153,848, filed Jan. 20, 2021 entitled "Press Hardening Steel With High Oxidation Resistance," 37 pages.

First Office Action for Chinese Patent Application No. 202010626153.2 dated Jun. 16, 2021 with correspondence dated Jun. 23, 2021 from China Patent Agent (H.K.) Ltd. summarizing contents, 10 pages.

Khanna, A.S., "Introduction to High Temperature Oxidation and Corrosion." ASM International, Materials Park, OH, p. 123 (2002).

First Office Action for Chinese Patent Application No. 201780098042.5 dated May 26, 2021 with English language machine translation, 20 pages.

Wang, Min et al., "Inverse evaluation of equivalent contact heat transfer coefficient in hot stamping of boron steel." The International Journal of Advanced Manufacturing Technology, vol. 87, pp. 2925-2932 (2016).

First Office Action for Chinese Patent Application No. 201880095869.5 dated Sep. 15, 2021 with correspondence dated Sep. 17, 2021 from China Patent Agent (H.K.) Ltd. summarizing contents, 9 pages.

Second Office Action for Chinese Patent Application No. 2020106261153.2 dated Mar. 9, 2022, with correspondence dated Mar. 14, 2022, from China Patent Agent (H.K.) Ltd summarizing contents; 12 pages.

Altan, Taylan, "Hot-stamping boron-alloyed steels for automotive parts—Part 1—Press Technology Tech Cell"; http://www.thefabricator.com/article/presstechnology/hot-stamping-boron-alloyed-steels-for-automotive-parts; Feb. 13, 2007; 3 pages.

Altan, Taylan, "Hot-stamping boron-alloyed steels for automotive parts—Part II—Press Technology Tech Cell"; http://www.thefabricator.com/article/presstechnology/hot-stamping-boron-alloyed-steels-for-automotive-parts-part-ii; Jan. 18, 2007; 2 pages.

Altan, Taylan, "Hot-stamping boron-alloyed steels for automotive parts—Part III—Press Technology Tech Cell"; http://www.thefabricator.com/article/presstechnology/hot-stamping-boron-alloyed-steels-for-automotive-parts-part-iii; Feb. 13, 2007; 2 pages.

Anonymous, "Process to improve oxidation resistance of press hardening steels," *Research Disclosure*, Database No. 641010 (Published online: Jul. 28, 2017), 2 pages.

Anonymous, "Steel Definitions, Today's AHSS for Automotive" *WorldAutoSteel*, [retrieved on Nov. 27, 2019]. Retrieved from the Internet: <URL: https://www.worldautosteel.org/steel-basics/automotive-steel-definitions/ <https://protect-us.mimecast.com/s/qVeXCADQNWCNqxzXcGLKQI>, 5 pages.

Anonymous, "Transformation-Induced Plasticity (TRIP) Steel" *WorldAutoSteel*, [retrieved on Nov. 27, 2019]. Retrieved from the Internet: <URL:https://www.worldautosteel.org/steel-basics/steel-types/transformation-induced-plasticity-trip-steel/>, 5 pages.

Anonymous, "TRIP steel" *Wikipedia*, [retrieved on Nov. 27, 2019], retrieved from the Internet: <URL: https://en.wikipedia.org/wiki/TRIP_steel>, 3 pages.

Davis, Joseph R. ed., "Dip, Barrier, and Chemical Conversion Coating," *Metals Handbook Desk Edition*, *ASM International*, 1998, p. 1154-1165 (Year: 1998).

(56) References Cited

OTHER PUBLICATIONS

Diekman, F. "Cold and Cryogenic Treatment of Steel," *ASM Handbook*, vol. 4A, *Steel Heat Treating Fundamentals and Processes*, pp. 382-386.
Dossett, John L. et al., "Practical Heat Treating," Second Edition (ASM International, 2006), pp. 7, 269. ISBN 1615031103 (Year: 2006).
First Office Action for Chinese Patent Application No. 201511036174.4 dated Feb. 28, 2017 with English language machine translation; 19 pages.
First Office Action for Chinese Patent Application No. 201680091625.0 dated Jul. 8, 2020 with English language machine translation, 11 pages.
First Office Action for Chinese Patent Application No. 201710222523.4 dated Apr. 27, 2018 and correspondence from China Patent Agent (H.K.) Ltd summarizing Office Action; 9 pages.
First Office Action for Chinese Patent Application No. 201710224443.2 dated May 3, 2018 and correspondence from China Patent Agent (H.K.) Ltd summarizing Office Action; 9 pages.
First Office Action for Chinese Patent Application No. 201810061046.2 dated Mar. 1, 2019 with English language machine translation; 18 pages.
First Office Action for German Patent Application No. 102015119417.1 dated Feb. 16, 2017; 5 pages.
First Office Action for German Patent Application No. 102017108835.0 dated Jul. 24, 2018 and correspondence dated Aug. 8, 2018 from Manitz Finsterwald Patentanwälte PartmbB summarizing contents; 6 pages.
First Office Action for German Patent Application No. 102017108837.7 dated Jul. 25, 2018 and correspondence from dated Aug. 8, 2018 Manitz Finsterwald Patentanwälte PartmbB summarizing contents; 6 pages.
First Office Action for German Patent Application No. 102018101735.9 dated May 3, 2019 with correspondence from Manitz Finsterwald Patentanwälte PartmbB summarizing contents, 6 pages.
Ghanbari, Zahra N. et al., "Zinc Coated Sheet Steel For Press Hardening (Master's Thesis)" Submitted to the Faculty and the Board of Trustees of the Colorado School of Mines, Fall 2014.
Grajcar, Adam et al.; "Phase Equilibrium and Austenite Decomposition in Advanced High-Strength Medium-Mn Bainitic Steels"; www.mdpi.com/journal/metals; Oct. 20, 2016; 14 pages.
International Search Report and Written Opinion for International Application No. PCT/CN2014/095753 dated Oct. 8, 2015; 8 pages (ISA/CN).
International Search Report and Written Opinion for International Application No. PCT/CN2016/110241 dated Sep. 25, 2017, 12 pages (ISA/CN).
International Search Report and Written Opinion for International Application No. PCT/CN2017/119484 dated Sep. 12, 2018, 9 pages (ISA/CN).
International Search Report and Written Opinion for International Application No. PCT/CN2018/088122 dated Feb. 26, 2019, 8 pages (ISA/CN).
International Search Report and Written Opinion for International Application No. PCT/CN2018/091751 dated Mar. 15, 2019, 9 pages (ISA/CN).
Karbasian, H. et al.; "A reviewon hot stamping"; Journal of Materials Processing Technology 210; Jul. 19, 2010; pp. 2103-2118.
Kurz, Thomas et al.; "Zinc Coated Press-Hardening Steel: Challenges and Solutions"; Voestalpine (Published Apr. 14, 2015), 12 pages.
Leonard, R. "Continuous Hot Dip Coatings," *Corrosion: Fundamentals, Testing, and Protection*, vol. 13A, ASM Handbook, *ASM International*, 2003, p. 786-796 (Year: 2003).
Liu, Hong-Sheng et al., "Hot Formation Quality of High Strength Steel BR1500HS for Hot Stamping without Cooling System," *Trans. Nonferrous Met. Soc. China* (2012), vol. 22, pp. s542-s547.
Lu, Qi et al., U.S. Appl. No. 16/460,369, filed Jul. 2, 2019 entitled, "Press Hardened Steel With Surface Layered Homogenous Oxide After Hot Forming," 50 pages.
Merklein, Marion et al., "A review on tailored blanks—Production, applications and evaluation," Journal of Materials Processing Technology (2014) 214, pp. 151-164; DOI: 10.1016/j.matprotec.2013.08.015 (Published online Sep. 6, 2013).
Mori, K. et al., "Warm and Hot Stamping of Ultra High Tensile Strength Steel Sheets Using Resistance Heating," CIRP Annals Manufacturing Technology (2005), vol. 54 (1), pp. 209-212.
Naderi, Malek et al., "Semi-hot Stamping as an Improved Process of Hot Stamping," *J. Mater. Sci. Technol.* (2011), vol. 27 (4) pp. 369-376.
Second Office Action for Chinese Patent Application No. 201511036174.4 dated Nov. 16, 2017 with English language machine translation; 15 pages.
Third Office Action for Chinese Patent Application No. 201511036174.4 dated Jul. 2, 2018 with English language machine translation; 26 pages.
Yi, H.L., "Dual-Phase Hot-Press Forming Alloy," Materials Science and Engineering A, 527 (2010). pp. 4870-4874.
U.S. Appl. No. 16/460,369, filed Jul. 2, 2019, Qi Lu et al.
Third Office Action for Chinese Patent Application No. 202010626153.2 dated Jun. 24, 2022, and correspondence from China Patent Agent (H.K.) Ltd summarizing Office Action; 22 pages.

* cited by examiner

METHOD FOR IMPROVING BOTH STRENGTH AND DUCTILITY OF A PRESS-HARDENING STEEL

CROSS REFERENCE TO RELATED APPLICATIONS

This application is a U.S. National Phase Application under 35 U.S.C. 371 of International Application No. PCT/CN2018/088122 filed on May 24, 2018. The entire disclosure of the above application is incorporated herein by reference.

INTRODUCTION

This section provides background information related to the present disclosure which is not necessarily prior art.

Press-hardened steel (PHS), also referred to as "hot-stamped steel" or "hot formed steel" is used in various industries and applications, including general manufacturing, construction equipment, automotive or other transportation industries, home or industrial structures, and the like. It is one of the strongest steels used for automotive body structural applications, having tensile strength properties on the order of about 1,500 mega-Pascal (MPa). Such steel has desirable properties, including forming steel components having high strength-to-weight ratios. For example, when manufacturing vehicles, especially automobiles, continual improvement in fuel efficiency and performance is desirable. PHS components are often used for forming load-bearing components, like door beams, which usually require high strength materials. Thus, the finished state of these steels are designed to have high strength and enough ductility to resist external forces such as, for example, resisting intrusion into the passenger compartment without fracturing so as to provide protection to the occupants. Moreover, galvanized PHS components may provide cathodic protection.

Many PHS processes involve austenitization in a furnace of a sheet steel blank, immediately followed by pressing and quenching of the sheet in dies. Austenitization is typically conducted in the range of about 880° C. to 950° C. There are two main types of PHS processes: indirect and direct. In the direct method, the PHS component is formed and pressed simultaneously between dies, which quenches the steel. In the indirect method, the PHS component is cold formed to an intermediate partial shape before austenitization and the subsequent pressing and quenching steps. The quenching of the PHS component hardens the component by transforming the microstructure from austenite to martensite. An oxide layer often forms during the transfer from the furnace to the dies. Therefore, after quenching, the oxide must be removed from the PHS component and the dies. The oxide is typically removed, i.e., descaled, by shot blasting.

The PHS component may be coated prior to applicable pre-cold forming (if the indirect process is used) or austenitization. Coating the PHS component provides a protective layer (e.g., galvanic protection) to the underlying steel component. Such coatings typically include an aluminum-silicon alloy and/or zinc. Zinc coatings offer cathodic protection; the coating acts as a sacrificial layer and corrodes instead of the steel component, even where the steel is exposed. Such coatings also generate oxides on PHS components' surfaces, which are removed by shot blasting. Accordingly, alloy compositions that do not require coatings and that provide improved strength and ductility are desired.

SUMMARY

This section provides a general summary of the disclosure, and is not a comprehensive disclosure of its full scope or all of its features.

In various aspects, the current technology provides a method of forming a shaped steel object. The method includes cutting a blank from an alloy composition. The alloy composition includes 0.1-1 wt. % carbon, 0.1-3 wt. % manganese, 0.1-3 wt. % silicon, 1-10 wt. % aluminum, and a balance being iron. The method also includes heating the blank to a temperature above a temperature at which austenite begins to form to generate a heated blank, transferring the heated blank to a die, forming the heated blank into a predetermined shape defined by the die to generate a shaped steel object, and decreasing the temperature of the shaped steel object to ambient temperature. The heating is performed under an atmosphere comprising at least one of an inert gas, a carbon (C)-based gas, and nitrogen ($N_2$) gas.

In one aspect, the alloy composition further includes chromium (Cr) at a concentration of greater than or equal to about 0 wt. % to less than or equal to about 5 wt. % of the alloy composition.

In one aspect, the alloy composition further includes at least one of nickel (Ni) at a concentration of greater than or equal to about 0 wt. % to less than or equal to about 1 wt. % of the alloy composition, molybdenum (Mo) at a concentration of greater than or equal to about 0 wt. % to less than or equal to about 1 wt. % of the alloy composition, niobium (Nb) at a concentration of greater than or equal to about 0 wt. % to less than or equal to about 0.1 wt. % of the alloy composition, vanadium (V) at a concentration of greater than or equal to about 0 wt. % to less than or equal to about 0.5 wt. % of the alloy composition, copper (Cu) at a concentration of greater than or equal to about 0 wt. % to less than or equal to about 1 wt. % of the alloy composition, titanium (Ti) at a concentration of greater than or equal to about 0 wt. % to less than or equal to about 0.5 wt. % of the alloy composition, and boron (B) at a concentration of greater than or equal to about 0 wt. % to less than or equal to about 0.005 wt. % of the alloy composition.

In one aspect, the Si is at a concentration of about 0.2 wt. % and the Al is at a concentration of greater than or equal to about 1 wt. % to less than or equal to about 5 wt. %.

In one aspect, the C is at a concentration of greater than or equal to about 0.2 wt. % to less than or equal to about 0.6 wt. %.

In one aspect, the alloy composition is in the form of a coil.

In one aspect, the heating the blank comprises heating the blank to a temperature of greater than or equal to about 900° C. to less than or equal to about 950° C.

In one aspect, the heating is performed for a time period of greater than or equal to about 2 min. to less than or equal to about 20 min.

In one aspect, the inert gas is selected from the group consisting of helium (He), neon (Ne), argon (Ar), krypton (Kr), xenon (Xe), and a combination thereof.

In one aspect, the C-based gas is selected from the group consisting of $CH_4$, $C_2H_6$, and a combination thereof.

In one aspect, the heating is performed under an atmosphere including a gas selected from the group consisting of He, Ne, Ar, Kr, Xe, $N_2$, $CH_4$, $C_2H_6$, and combinations thereof.

In one aspect, after the decreasing the temperature of the stamped object to ambient temperature, the method further includes heating the shaped steel object to a temperature below a martensite start (Ms) temperature.

In one aspect, the heating the shaped steel object to a temperature below the Ms temperature includes heating the shaped object to a temperature of greater than or equal to about 100° C. to less than or equal to about 400° C. for a time period of greater than or equal to about 0.1 min. to less than or equal to about 60 min.

In one aspect, the method further includes cooling the shaped object to ambient temperature.

In various aspects, the current technology also provides a method of forming a shaped steel object. The method including cutting a blank from an alloy composition, the alloy composition including carbon (C) at a concentration of greater than or equal to about 0.2 wt. % to less than or equal to about 0.6 wt. % of the alloy composition, manganese (Mn) at a concentration of greater than or equal to about 0.1 wt. % to less than or equal to about 3 wt. % of the alloy composition, silicon (Si) at a concentration of greater than or equal to about 0.1 w. % to less than or equal to about 3 wt. % of the alloy composition, aluminum (Al) at a concentration of greater than or equal to about 1 wt. % to less than or equal to about 5 wt. % of the alloy composition, and a balance of the alloy composition being iron (Fe). The method also includes austenitizing the blank under an atmosphere comprising an inert gas to generate an austenitized blank, forming the austenitized blank into a predetermined shape to generate a shaped object, decreasing a temperature of the shaped object to ambient temperature at a constant rate to generate a shaped steel object, and heating the shaped steel object to a temperature of greater than or equal to about 100° C. to less than or equal to about 400° C. for a time period of greater than or equal to about 2 min. to less than or equal to about 30 min.

In one aspect, the Al is at a concentration of greater than or equal to about 3 wt. % to less than or equal to about 4 wt. % of the alloy composition.

In one aspect, the method is free of shot blasting.

In one aspect, the decreasing the temperature of the shaped steel object to ambient temperature at a constant rate includes cooling the shaped steel object at a rate of greater than or equal to about 15° C./s until ambient temperature is reached.

In various aspects, the current technology yet further provides a shaped steel object. The shaped steel object includes an alloy composition having a shape. The alloy composition includes carbon (C) at a concentration of greater than or equal to about 0.2 wt. % to less than or equal to about 0.6 wt. % of the alloy composition, manganese (Mn) at a concentration of greater than or equal to about 0.1 wt. % to less than or equal to about 3 wt. % of the alloy composition, silicon (Si) at a concentration of greater than or equal to about 0.1 w. % to less than or equal to about 3 wt. % of the alloy composition, aluminum (Al) at a concentration of greater than or equal to about 1 wt. % to less than or equal to about 5 wt. % of the alloy composition, and a balance of the alloy composition being iron (Fe). The alloy composition was austenitized under at least one of an inert gas, a carbon (C)-based gas, and nitrogen ($N_2$) gas prior to being formed into the shape, formed into the shape, and subjected to a post-heat treatment. The shaped steel object has a higher strength and a higher ductility relative to a second shaped object that was not austenitized under at least one of an inert gas, a carbon (C)-based gas, and nitrogen ($N_2$) gas and subjected to a post-heat treatment.

In one aspect, the shaped steel object is a part of an automobile.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
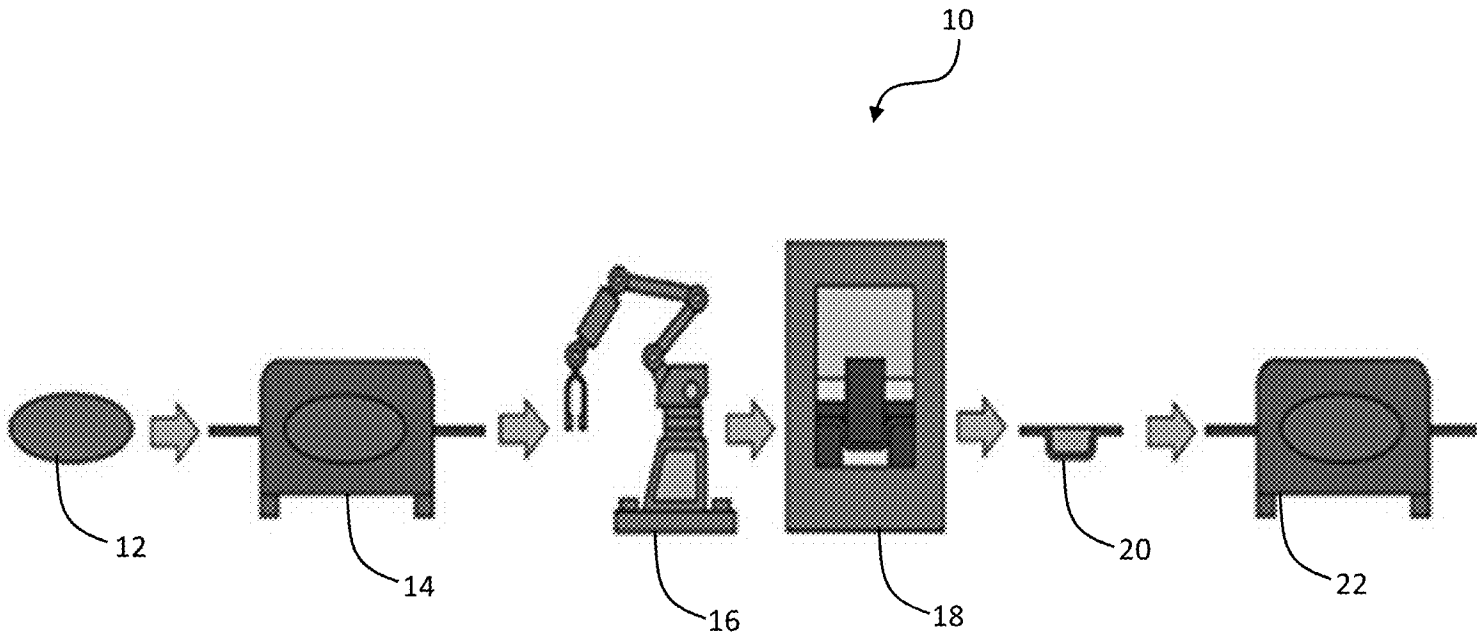
FIG. 1 is a flow chart showing aspects of a method for making a shaped steel object according to various aspects of the current technology.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

High aluminum steel is used in traditional hot stamping methods to provide a coating-free steel. However, the coating-free steel is decarburized during the hot stamping, which decreases steel strength. Moreover, a brittle martensite phase results in a decrease in ductility. Accordingly, the present technology provides a hot stamping method that minimizes decarburization during austenization, increases stability of retained austenite, and ductile martensite by a post-heat treatment.

The method provided by the current technology is performed with a press-hardened steel (PHS) alloy composition having a high aluminum concentration. The alloy composition generates coating free steel with a low density of less than or equal to about 5%. The alloy composition comprises aluminum (Al) at a concentration of greater than or equal to about 1 wt. % to less than or equal to about 10 wt. %, greater than or equal to about 2 wt. % to less than or equal to about 5 wt. %, or greater than or equal to about 3 wt. % to less than or equal to about 4 wt. %.

The alloy composition also comprises carbon (C) at a concentration of greater than or equal to about 0.1 wt. % to less than or equal to about 1 wt. %, greater than or equal to about 0.15 wt. % to less than or equal to about 0.8 wt. %, or greater than or equal to about 0.2 wt. % to less than or equal to about 0.6 wt. %.

The alloy composition also comprises manganese (Mn) at a concentration of greater than or equal to about 0 wt. % to less than or equal to about 3 wt. %, greater than or equal to about 0.25 wt. % to less than or equal to about 2.5 wt. %, greater than or equal to about 0.5 wt. % to less than or equal to about 2 wt. %, greater than or equal to about 0.75 wt. % to less than or equal to about 1.5 wt. %, or greater than or equal to about 1 wt. % to less than or equal to about 1.5 wt. %.

The alloy composition also comprises silicon (Si) at a concentration of greater than or equal to about 0 wt. % to less than or equal to about 3 wt. %, greater than or equal to about 0.25 wt. % to less than or equal to about 2.5 wt. %, greater than or equal to about 0.5 wt. % to less than or equal to about 2 wt. %, greater than or equal to about 0.75 wt. % to less than or equal to about 1.5 wt. %, or greater than or equal to about 1 wt. % to less than or equal to about 1.5 wt. %. In some embodiments, the alloy composition comprises about 0.2 wt. % Si.

A balance of the alloy composition is iron (Fe).

In various embodiments, the alloy composition further comprises chromium (Cr) at a concentration of greater than or equal to about 0 wt. % to less than or equal to about 5 wt. %, greater than or equal to about 0.1 wt. % to less than or equal to about 4.5 wt. %, greater than or equal to about 1 wt. % to less than or equal to about 4 wt. %, greater than or equal to about 2 wt. % to less than or equal to about 3 wt. %, greater than or equal to about 0.075 wt. % to less than or equal to about 0.25 wt. %, or greater than or equal to about 0.1 wt. % to less than or equal to about 0.2 wt. %.

In various embodiments, the alloy composition further comprises nickel (Ni) at a concentration of greater than or equal to about 0 wt. % to less than or equal to about 1 wt. %, or less than or equal to about 0.8 wt. %. In some embodiments, the alloy composition is substantially free of Ni. As used herein, "substantially free" means that only trace levels of a component are present, such as levels of less than or equal to about 1 wt. %, less than or equal to about 0.5 wt. %, or levels that are not detectable.

In various embodiments, the alloy composition further comprises molybdenum (Mo) at a concentration of greater than or equal to about 0 wt. % to less than or equal to about 1 wt. %, or less than or equal to about 0.8 wt. %. In some embodiments, the alloy composition is substantially free of Mo.

In various embodiments, the alloy composition further comprises copper (Cu) at a concentration of greater than or equal to about 0 wt. % to less than or equal to about 1 wt. %, or less than or equal to about 0.8 wt. %. In some embodiments, the alloy composition is substantially free of Cu.

In various embodiments, the alloy composition further comprises niobium (Nb) at a concentration of greater than or equal to about 0 wt. % to less than or equal to about 0.1 wt. %, or less than or equal to about 0.005 wt. %. In some embodiments, the alloy composition is substantially free of Nb.

In various embodiments, the alloy composition further comprises vanadium (V) at a concentration of greater than or equal to about 0 wt. % to less than or equal to about 0.5 wt. %, or less than or equal to about 0.25 wt. %. In some embodiments, the alloy composition is substantially free of V.

In various embodiments, the alloy composition further comprises titanium (Ti) at a concentration of greater than or equal to about 0 wt. % to less than or equal to about 0.5 wt. %, or less than or equal to about 0.25 wt. %. In some embodiments, the alloy composition is substantially free of Ti.

In various embodiments, the alloy composition further comprises boron (B) at a concentration of greater than or equal to about 0 wt. % to less than or equal to about 0.005 wt. %, or less than or equal to about 0.001 wt. %. In some embodiments, the alloy composition is substantially free of B.

The alloy composition can include various combinations of Al, C, Mn, Si, Cr, Ni, Mo, Nb, V, Cu, Ti, B, and Fe at their respective concentrations described above. In some embodiments, the alloy composition consists essentially of Al, C, Mn, Si, Cr, and Fe. As described above, the term "consists essentially of" means the alloy composition precludes additional compositions, materials, components, elements, and/or features that materially affect the basic and novel characteristics of the alloy composition, but any compositions, materials, components, elements, and/or features that do not materially affect the basic and novel characteristics can be included in the embodiment. Therefore, when the alloy composition consists essentially of Al, C, Mn, Si, Cr, and Fe, the alloy composition can also include any combination of Ni, Mo, Nb, V, Cu, Ti, and B that does not materially affect the basic and novel characteristics of the alloy composition. In other embodiments, the alloy composition consists of Al, C, Mn, Si, Cr, and Fe, in their respective concentrations described above, and at least one of Ni, Mo, Nb, V, Cu, Ti, and B in no more than trace amounts, such as at levels of less than or equal to about 1.5%, less than or equal to about 1%, less than or equal to about 0.5%, or levels that are not detectable. Other elements that are not described herein can also be included in trace amounts with the proviso that they do not materially affect the basic and novel characteristics of the alloy composition.

In one embodiment, the alloy composition consists essentially of Al, C, Mn, Si, Cr, and Fe. In another embodiment, the alloy composition consists of Al, C, Mn, Si, Cr, and Fe.

In one embodiment, the alloy composition consists essentially of Al, C, Mn, Si, and Fe. In another embodiment, the alloy composition consists of Al, C, Mn, Si, and Fe.

In one embodiment, the alloy composition consists essentially of Al, C, Mn, Si, Cr, Mo, and Fe. In another embodiment, the alloy composition consists of Al, C, Mn, Si, Cr, Mo, and Fe.

In one embodiment, the alloy composition consists essentially of Al, C, Mn, Si, Cr, Mo, Nb, V, and Fe. In another embodiment, the alloy composition consists of Al, C, Mn, Si, Cr, Mo, Nb, V, and Fe.

In one embodiment, the alloy composition consists essentially of Al, C, Mn, Si, Cr, Mo, Nb, V, Ni, and Fe. In another embodiment, the alloy composition consists of Al, C, Mn, Si, Cr, Mo, Nb, V, Ni, and Fe.

In one embodiment, the alloy composition consists essentially of Al, C, Mn, Si, Cr, Mo, Nb, V, Ni, Cu, and Fe. In another embodiment, the alloy composition consists of Al, C, Mn, Si, Cr, Mo, Nb, V, Ni, Cu, and Fe.

In one embodiment, the alloy composition consists essentially of C, Mn, Si, Cr, Mo, Nb, V, Ni, Cu, Ti, and Fe. In another embodiment, the alloy composition consists of C, Mn, Si, Cr, Mo, Nb, V, Ni, Cu, Ti, and Fe.

In one embodiment, the alloy composition consists essentially of C, Mn, Si, Cr, Mo, Nb, V, Ni, Cu, B, and Fe. In another embodiment, the alloy composition consists of C, Mn, Si, Cr, Mo, Nb, V, Ni, Cu, B, and Fe.

In one embodiment, the alloy composition consists essentially of C, Mn, Si, Cr, Mo, Nb, V, Ni, Cu, Ti, B, and Fe. In another embodiment, the alloy composition consists of C, Mn, Si, Cr, Mo, Nb, V, Ni, Cu, Ti, B, and Fe.

The alloy composition also comprises chromium and aluminum, wherein the alloy composition has either high chromium content and relatively low aluminum content or high aluminum content and relatively low chromium content.

In various aspects, a balance of the alloy composition is iron.

The alloy composition is rolled into a coil or provided as a sheet and stored for future use. The alloy composition is provided without pre-oxidation. However, in some embodiments, the alloy composition provided in a coil or sheet is pre-oxidized.

With reference to FIG. 1, the current technology provides a method 10 of forming a shaped steel object. The shaped steel object can be any object that is generally made by hot stamping, such as, for example, a vehicle part. Non-limiting examples of vehicles that have parts suitable to be produced by the current method include bicycles, automobiles, motorcycles, boats, tractors, buses, mobile homes, campers, gliders, airplanes, and military vehicles such as tanks.

The method 10 comprises cutting a blank 12 from an alloy composition provided as a coil or sheet. The alloy composition can be any alloy composition described herein. The method then comprises transferring the blank 12 to a furnace or oven 14, and austenitizing the blank 12 by heating the blank 12 to a temperature above a temperature at which austenite begins to form (Ac1) to generate a heated blank. In various embodiments, the heating comprises heating the blank 12 to a temperature of greater than or equal to about 880° C. to less than or equal to about 1000° C., or greater than or equal to about 900° C. to less than or equal to about 950° C. The heating is performed for a time period of greater than or equal to about 2 min. to less than or equal to about 20 min., or greater than or equal to about 5 min. to less than or equal to about 10 min.

The heating is performed under an atmosphere comprising at least one of an inert gas, a carbon-based gas, and nitrogen gas ($N_2$). In various embodiments, the inert gas is helium (He), neon (Ne), argon (Ar), krypton (Kr), xenon (Xe), or a combination thereof, and the carbon-based gas is methane ($CH_4$), ethane ($C_2H_6$), or a combination thereof. Accordingly, the heating is performed in the presence of a gas selected from the group consisting of He, Ne, Ar, Kr, Xe, $N_2$, $CH_4$, $C_2H_6$, and a combination thereof.

Optionally by a robotic arm 16, the heated blank is transferred to a press 18. Here, the method 10 comprises forming the heated blank into a predetermined shape defined by the press. In various embodiments, the forming comprises stamping the heated blank to generate a stamped object having the predetermined shape.

While in the press 18, the method 10 also comprises quenching the stamped object to form a shaped steel object 20. The quenching comprises decreasing a temperature of the stamped object to ambient temperature, where the shaped steel object 20 is generated. In various embodiments, the method 10 is free of at least one of a pre-oxidation step, a coating step, and a descaling step (e.g., shot blasting).

Next, the method 10 comprises performing a post-heat treatment. The post-heat treatment comprises transferring the shaped steel object to second oven or furnace 22 and heating the shaped steel object 20 to a treatment temperature above a martensite finish (MO temperature, but below a martensite start (Ms) temperature of the alloy composition. In various embodiments, the heating comprises heating the shaped steel object 20 to a temperature of greater than or equal to about 100° C. to less than or equal to about 400° C. for a time period of greater than or equal to about 0.1 min to less than or equal to about 60 min., or greater than or equal to about 2 min. to less than or equal to about 30 min. The method 10 also includes cooling the shaped steel object back to ambient temperature.

Figure 2:
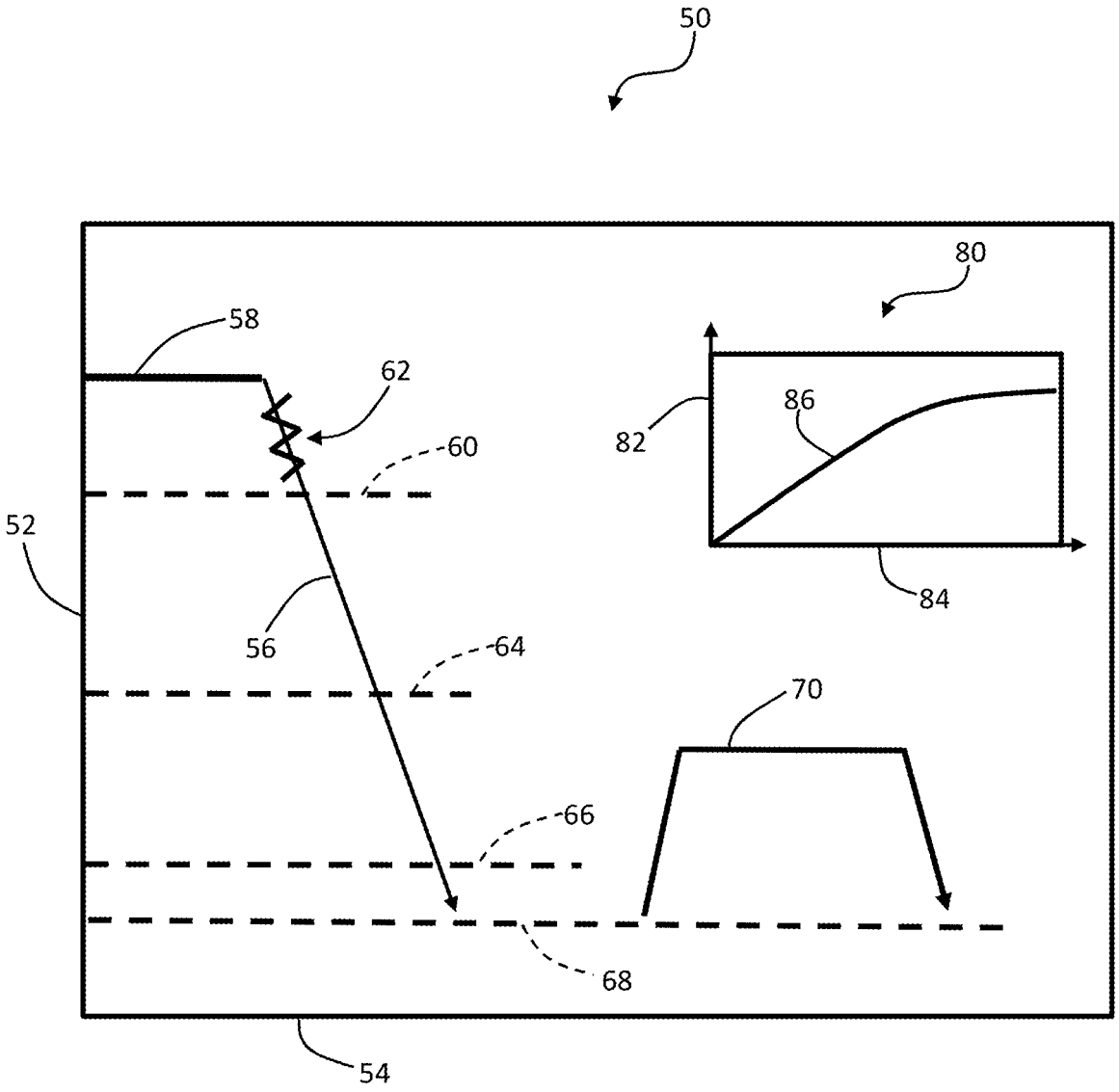
FIG. 2 is a graph showing a temperature profile used in a method for making a shaped steel object according to various aspects of the current technology.

The method 10 is further described in FIG. 2, which shows a graph 50 having a y-axis 52 representing temperature and an x-axis 54 representing time. A line 56 on the graph 50 is a cooling profile for an alloy composition. Here, the blank is austenitized, i.e., heated to a final temperature 58 that is above a temperature at which a transformation of ferrite to austenite begins (Ac1) 60 of the alloy composition. The final temperature 58, as described above, is greater than or equal to about 880° C. to less than or equal to about 1000° C., or greater than or equal to about 900° C. to less than or equal to about 950° C.

The austenitized blank is then stamped or hot formed into a stamped object in a press at a temperature 62 between the final temperature 58 and the Ac1 60. The stamped object is then quenched, i.e., cooled, at a constant rate of greater than or equal to about 1° C. $s^{-1}$, greater than or equal to about 5° C. $s^{-1}$, greater than or equal to about 10° C. $s^{-1}$, greater than or equal to about 15° C. $s^{-1}$, or greater than or equal to about 20° C. $s^{-1}$, such as at a rate of about 1° C. $s^{-1}$, about 3° C. $s^{-1}$, about 5° C. $s^{-1}$, about 10° C. $s^{-1}$, about 15° C. $s^{-1}$, about 20° C. $s^{-1}$, about 25° C. $s^{-1}$, about 30° C. $s^{-1}$, or faster until the temperature decreases below a martensite start (Ms) temperature 64 to an ambient temperature 68 to form a shaped steel object.

The post-heat treatment then comprises heating the shaped steel object to a temperature above ambient temperature 68, such as at a treatment temperature 70 of greater than or equal to about 100° C. to less than or equal to about 400° C. for a time period of greater than or equal to about 0.1 min. to less than or equal to about 60 min, or greater than or equal to about 2 min. to less than or equal to about 30 min., as described above. Cooling the shaped steel object back to the ambient temperature 68 completes the method.

An inset graph 80 shown in FIG. 2 has a y-axis 82 corresponding to austenite stability and an x-axis 84 corresponding to carbon content in austenite. As shown by line 86, a high carbon content results in an increase of retained austenite (RA) stability. This increase in RA stability is associated with a decrease carbon content in the martensite, which increases the ductility of martensiteFF. Without being bound by theory, it appears that the inert gases decrease the reaction between C and active gases, which normally leads to decarburization.

Figure 3:
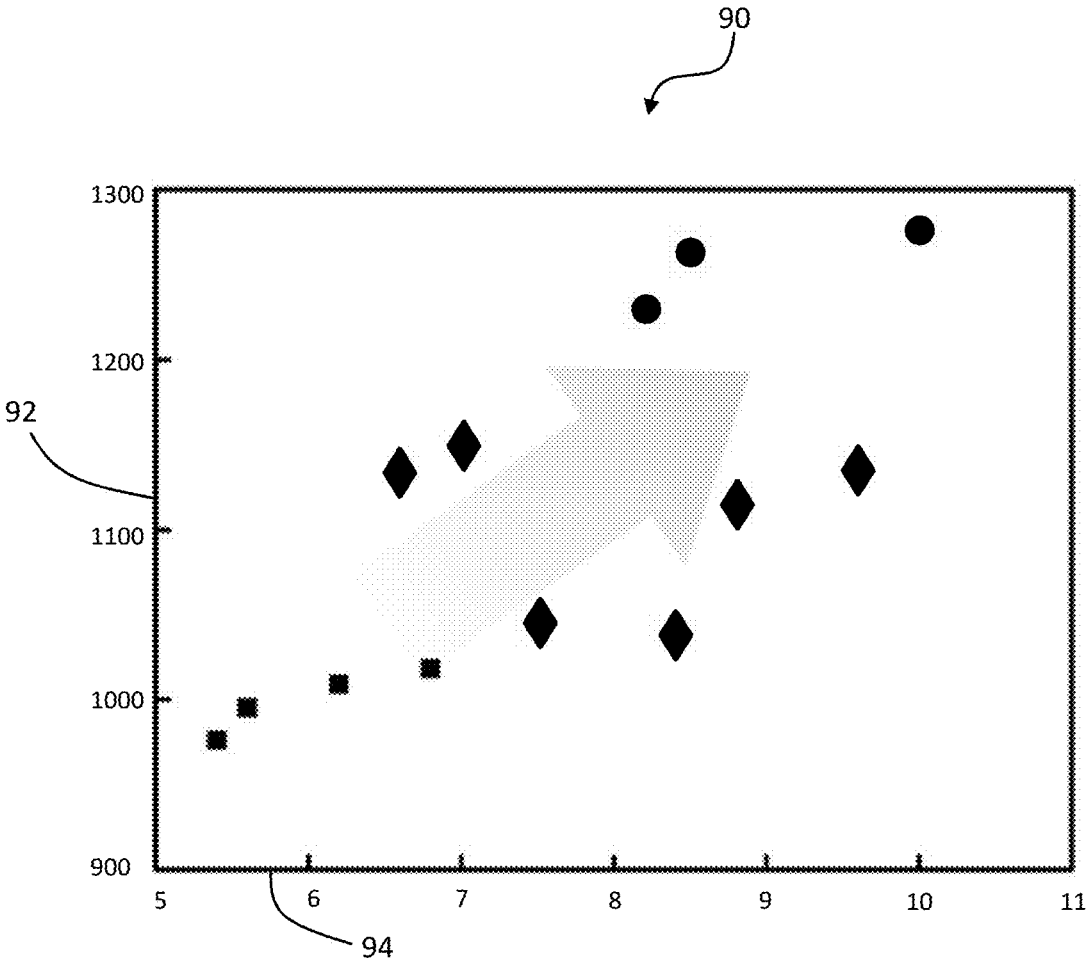
FIG. 3 is a graph showing strength and ductility of a shaped steel object made according to various aspects of the current technology and of shaped steel objects made by alternative methods.

With reference to FIG. 3, three shaped steel objects are made with the alloy composition described herein. A first shaped steel object is made without an inert gas during austenitization and without the post-heat treatment. A second shaped steel object is made with a post-heat treatment, but without an inert gas during austenitization. A third shaped steel object is made using both an inert gas during austenitization and with a post-heat treatment. A graph 90 is shown with a y-axis 92 corresponding to stress (from 900-1300 MPa) and an x-axis 94 corresponding to strain (from 5-11%). The first shaped steel object is represented by squares, the second shaped steel object is represented by diamonds, and the third shaped steel object is represented by circles. As shown in the graph 90, the first shaped steel object results in about 1100 MPa/5-7%, the second shaped steel object results in about 1150 MPa/6-10%, and the third shaped steel object results in about 1270 MPa/8-10%. Accordingly, the method of the current technology improves both strength and ductility for the alloy composition.

The current technology further provides a shaped steel object made by the above method. The shaped steel object has a higher strength and a higher ductility relative to a second shaped object that was not austenitized under an inert temperature and subjected to a post-heat treatment. The shaped steel object may be part of an automobile or other vehicle as exemplified above.

In various aspects of the current technology, the alloy composition is austenitized, quenched, and subjected to the post-heat treatment to form an advanced high strength steel (AHSS), and then formed into a coil or provided as sheet. This AHSS, which can be Zn-coated or bare (not coated), is suitable for making shaped objects by cold stamping at ambient temperature.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of forming a shaped steel object, the method comprising:

cutting a blank from an alloy composition, the alloy composition comprising:

carbon (C) at a concentration of greater than or equal to about 0.1 wt. % to less than or equal to about 1 wt. % of the alloy composition, manganese (Mn) at a concentration of greater than or equal to about 0.1 wt. % to less than or equal to about 3 wt. % of the alloy composition, silicon (Si) at a concentration of greater than or equal to about 0.1 wt. % to less than or equal to 0.4 wt. % of the alloy composition, aluminum (Al) at a concentration of greater than or equal to about 1 wt. % to less than or equal to about 10 wt. % of the alloy composition, and a balance of the alloy composition being iron (Fe);

heating the blank to a temperature above a temperature at which austenite begins to form (Ac1) to generate a heated blank, wherein the heating is performed under an atmosphere comprising at least one of an inert gas, a carbon-based gas, and nitrogen gas ($N_2$);

transferring the heated blank to a die;

forming the heated blank into a predetermined shape defined by the die to generate a stamped object; and decreasing the temperature of the stamped object to ambient temperature to form a shaped steel object.

2. The method according to claim 1, wherein the alloy composition further comprises:

chromium (Cr) at a concentration of greater than or equal to about 0 wt. % to less than or equal to about 5 wt. % of the alloy composition.

3. The method according to claim 2, wherein the alloy composition further comprises at least one of:

nickel (Ni) at a concentration of greater than or equal to about 0 wt. % to less than or equal to about 1 wt. % of the alloy composition, molybdenum (Mo) at a concentration of greater than or equal to about 0 wt. % to less than or equal to about 1 wt. % of the alloy composition, niobium (Nb) at a concentration of greater than or equal to about 0 wt. % to less than or equal to about 0.1 wt. % of the alloy composition, vanadium (V) at a concentration of greater than or equal to about 0 wt. % to less than or equal to about 0.5 wt. % of the alloy composition, copper (Cu) at a concentration of greater than or equal to about 0 wt. % to less than or equal to about 1 wt. % of the alloy composition, titanium (Ti) at a concentration of greater than or equal to about 0 wt. % to less than or equal to about 0.5 wt. % of the alloy composition, and boron (B) at a concentration of greater than or equal to about 0 wt. % to less than or equal to about 0.005 wt. % of the alloy composition.

4. The method according to claim 1, wherein the Si is at a concentration of about 0.2 wt. % and the Al is at a concentration of greater than or equal to about 1 wt. % to less than or equal to about 5 wt. %.

5. The method according to claim 1, wherein the C is at a concentration of greater than or equal to about 0.2 wt. % to less than or equal to about 0.6 wt. %.

6. The method according to claim 1, wherein the alloy composition is in coil form.

7. The method according to claim 1, wherein the heating the blank comprises heating the blank to a temperature of greater than or equal to about 900° C. to less than or equal to about 950° C.

8. The method according to claim 1, wherein the heating is performed for a time period of greater than or equal to about 2 min. to less than or equal to about 20 min.

9. The method according to claim 1, where the inert gas is selected from the group consisting of helium (He), neon (Ne), argon (Ar), krypton (Kr), xenon (Xe), and combinations thereof.

10. The method according to claim 1, wherein the carbon-based gas is selected from the group consisting of $CH_4$, $C_2H_6$, and combinations thereof.

11. The method according to claim 1, wherein the heating is performed under an atmosphere comprising a gas selected from the group consisting of He, Ne, Ar, Kr, Xe, $N_2$, $CH_4$, $C_2H_6$, and combinations thereof.

12. The method according to claim 1, wherein after the decreasing the temperature of the stamped object to ambient temperature, the method further comprises:

heating the shaped steel object to a temperature below a martensite start (Ms) temperature.

13. The method according to claim 12, wherein the heating the shaped steel object to a temperature below the Ms temperature comprises heating the shaped steel object to a temperature of greater than or equal to about 100° C. to less than or equal to about 400° C. for a time period of greater than or equal to about 0.1 min. to less than or equal to about 60 min.

14. The method according to claim 13, further comprising:

cooling the shaped steel object to ambient temperature.

15. A method of forming a shaped steel object, the method comprising:

cutting a blank from an alloy composition, the alloy composition comprising:

carbon (C) at a concentration of greater than or equal to about 0.2 wt. % to less than or equal to about 0.6 wt. % of the alloy composition, manganese (Mn) at a concentration of greater than or equal to about 0.1 wt. % to less than or equal to about 3 wt. % of the alloy composition, silicon (Si) at a concentration of greater than or equal to about 0.1 wt. % to less than or equal to 0.4 wt. % of the alloy composition, aluminum (Al) at a concentration of greater than or equal to about 1 wt. % to less than or equal to about 5 wt. % of the alloy composition, and a balance of the alloy composition being iron (Fe);

heating the blank to a temperature above a temperature at which austenite begins to form (Ac1) to generate an austenitized blank, wherein the heating is performed under an atmosphere comprising at least one of an inert gas, a carbon-based gas, and nitrogen gas ($N_2$);

transferring the austenitized blank to a die;

forming the austenitized blank into a predetermined shape defined by the die to generate a shaped object;

decreasing a temperature of the shaped object to ambient temperature at a constant rate to generate a shaped steel object; and heating the shaped steel object to a temperature of greater than or equal to about 100° C. to less than or equal to about 400° C. for a time period of greater than or equal to about 2 min. to less than or equal to about 30 min.

16. The method according to claim 15, wherein the Al is at a concentration of greater than or equal to about 3 wt. % to less than or equal to about 4 wt. % of the alloy composition.

17. The method according to claim 15, wherein the method is free of shot blasting.

18. The method according to claim 15, wherein the decreasing the temperature of the shaped steel object to ambient temperature at a constant rate comprises cooling the shaped steel object at a rate of greater than or equal to about 15° C./s until ambient temperature is reached.

* * * * *